US007717361B2

(12) United States Patent
Nelson et al.

(10) Patent No.: US 7,717,361 B2
(45) **Date of Patent: *May 18, 2010**

(54) DISTRIBUTOR PLATE WITH DIFFUSER ON FIXED SHAFT

(75) Inventors: Craig Nelson, Walla Walla, WA (US); George L. Sesser, Walla Walla, WA (US); Patrick T. Barry, Wala Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 544 days.

This patent is subject to a terminal disclaimer.

(21) Appl. No.: 11/513,014

(22) Filed: Aug. 31, 2006

(65) Prior Publication Data

US 2008/0054094 A1 Mar. 6, 2008

(51) Int. Cl.
*B05B 3/04* (2006.01)

(52) U.S. Cl. ..... 239/222.17; 239/222.11; 239/223; 239/231; 239/252

(58) Field of Classification Search ..... 239/222.17, 239/222.21, 223, 224, 231, 232, 252, 259, 239/222.11, 230

See application file for complete search history.

(56) References Cited

U.S. PATENT DOCUMENTS

| | | | | |
|---|---|---|---|---|
| 3,727,842 | A | 4/1973 | Ertsgaard et al. | |
| 4,375,513 | A | 3/1983 | Debono et al. | |
| 4,836,449 | A | 6/1989 | Hunter | |
| 4,836,450 | A | 6/1989 | Hunter | |
| 4,957,240 | A | 9/1990 | Rosenberg | |
| 5,192,024 | A | 3/1993 | Blee | |
| 5,288,022 | A | 2/1994 | Sesser | |
| 5,372,307 | A | 12/1994 | Sesser | |
| 5,671,886 | A | 9/1997 | Sesser | |
| 5,718,381 | A * | 2/1998 | Katzer et al. | 239/222.11 |
| 6,899,287 | B2 * | 5/2005 | Pinch et al. | 239/252 |
| 7,025,287 | B2 * | 4/2006 | Perkins | 239/222.17 |
| 7,086,608 | B2 * | 8/2006 | Perkins | 239/222.17 |
| 7,395,977 | B2 * | 7/2008 | Pinch et al. | 239/222.21 |
| 2004/0050955 | A1 | 3/2004 | Sesser et al. | |
| 2004/0195359 | A1 | 10/2004 | Curtis | |

FOREIGN PATENT DOCUMENTS

| | | |
|---|---|---|
| EP | 0339966 | 11/1989 |
| EP | 0518579 | 10/2004 |

OTHER PUBLICATIONS

European Search Report dated Jul. 18, 2008 of Application No. EP 07 25 3233.

* cited by examiner

*Primary Examiner*—Steven J Ganey
(74) *Attorney, Agent, or Firm*—Nixon & Vanderhye, P.C.

(57) ABSTRACT

A water distribution plate and diffuser plate assembly for distributing a stream emitted from a sprinkler nozzle comprising: a shaft having one end attached to a sprinkler component and an opposite end supporting first and second plates in axially spaced relationship for rotation about the shaft independent of one another; the first plate located adjacent the nozzle and formed with at least one water distribution groove shaped and arranged to divide a primary stream emitted from the nozzle into a plurality of secondary streams, and the second plate located downstream of the first plate and formed with at least one diffuser element arranged to be struck by at least some of the secondary streams exiting the first plate, and wherein speed of rotation of the first and second plates is braked.

24 Claims, 4 Drawing Sheets

DISTRIBUTOR PLATE WITH DIFFUSER ON FIXED SHAFT

BACKGROUND OF THE INVENTION

This invention relates to rotary sprinklers and, more specifically, to a rotary sprinkler having a stream diffuser driven in random fashion by a stream emitted from a fixed nozzle and redirected by a grooved water distribution plate.

Stream interrupters or diffusers per se are utilized for a variety of reasons and representative examples may be found in U.S. Pat. Nos. 5,192,024; 4,836,450; 4,836,449; 4,375,513; and 3,727,842.

One reason for providing stream interrupters or diffusers is to enhance the uniformity of the sprinkling pattern. When irrigating large areas, the sprinklers are spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinkler patterns. These requirements are achieved to some degree with a single concentrated stream of water shooting at a relatively high trajectory angle (approximately 24° from horizontal), but streams of this type produce a nonuniform "donut pattern". Interrupting a single concentrated stream, by fanning some of it vertically downwardly, produces a more even pattern but also reduces the radius of throw.

Proposed solutions to the above problem may be found in commonly owned U.S. Pat. Nos. 5,372,307 and 5,671,886. The solutions disclosed in these patents involve intermittently interrupting the stream so that at times, the stream is undisturbed for maximum radius of throw, while at other times, it is fanned to even out the pattern. In both of the above-identified commonly owned patents, the rotational speed of the water distribution plate is slowed by a viscous fluid brake to achieve both maximum throw and maximum stream integrity.

There remains a need for an even more efficient stream interrupter or diffuser configuration to achieve more uniform wetted pattern areas.

BRIEF DESCRIPTION OF THE INVENTION

In the exemplary embodiments of this invention, a water distribution plate and a stream diffuser plate are both mounted for rotation on a single, fixed shaft. The water distribution and diffuser plates rotate independently of one another, however, and both are viscously braked to slow the rate of rotation of the plates.

In one exemplary embodiment, a shaft extends upwardly through the nozzle of a sprinkler head or body and supports the water distribution plate and diffuser plate downstream of an arcuate or full circle stream emitted from the nozzle. The water distribution plate is generally cone-shaped and formed with a plurality of grooves that are slightly curved in a circumferential direction so that the stream impinging on the grooves causes the plate to rotate about the shaft. A first stator component is fixed to the shaft and located within a sealed chamber in the water distribution plate, the chamber at least partially filled with a viscous fluid that causes the rate of rotation of the water distribution plate to be significantly slowed in comparison to an unbraked rate of rotation.

Downstream of the water distribution plate, the diffuser plate is mounted on the shaft in a similar manner, with a second sealed stator element fixed to the shaft in a chamber at least partially filled with viscous fluid. The diffuser plate is provided with a plurality of diffuser elements projecting downwardly from a peripheral edge of the lower surface of the diffuser.

The water distribution plate rotates at a specific and substantially constant speed, while the diffuser plate rotates at an intermittent and random speed. More specifically, the diffuser plate is designed such that when one or more stream components from the water distribution plate impinges on a diffuser element, the stream components break up to fill in the wetted pattern area while at the same time, the diffuser element is driven to a new and random position. In this regard, the diffuser elements are provided with curved vane surfaces that cause the diffuser plate to rotate when struck by stream components emitted from the water distribution plate.

In a second exemplary embodiment, the water distribution plate and diffuser plate are again mounted on a single shaft, but the shaft is supported within a cap assembly that is in turn supported on the sprinkler body downstream of the nozzle. Thus, in this embodiment, the shaft does not project upwardly through the sprinkler nozzle. Otherwise, the mounting of the water distribution plate and diffuser plate on the single fixed shaft, and the viscous damping arrangement remains substantially as described hereinabove.

Accordingly, in a first aspect, the invention relates to a water distribution plate and diffuser plate assembly for distributing a stream emitted from a sprinkler nozzle comprising: a shaft having one end attached to a sprinkler component and an opposite end supporting first and second plates in axially spaced relationship for rotation about the shaft independent of one another; the first plate located adjacent the nozzle and formed with at least one water distribution groove shaped and arranged to divide a primary stream emitted from the nozzle into a plurality of secondary streams, and the second plate located downstream of the first plate and formed with at least one diffuser element arranged to be struck by at least some of the secondary streams exiting the first plate, and wherein speed of rotation of the first and second plates is braked.

In another aspect, the invention relates to a water distribution plate and diffuser plate assembly for distributing a stream emitted from a sprinkler nozzle comprising: a shaft having one end attached to a sprinkler component and an opposite end supporting first and second plates in axially spaced relationship for rotation about the shaft independent of one another; the first plate located adjacent the nozzle and formed with at least one water distribution groove shaped and arranged to divide a primary stream emitted from the nozzle into a plurality of secondary streams, and the second plate located downstream of the first plate and formed with at least one diffuser element arranged to be struck by at least some of the secondary streams exiting the first plate; the first plate formed with a first internal chamber, with a first stator element secured to the shaft and received in the first internal chamber, the second plate formed with a second internal chamber, with a second stator element secured to the shaft and received in the second internal chamber, the first and second internal chambers at least partially filled with a viscous fluid.

The invention will now be described in detail in connection with the drawings identified below.

DETAILED DESCRIPTION OF THE INVENTION

Figure 1:
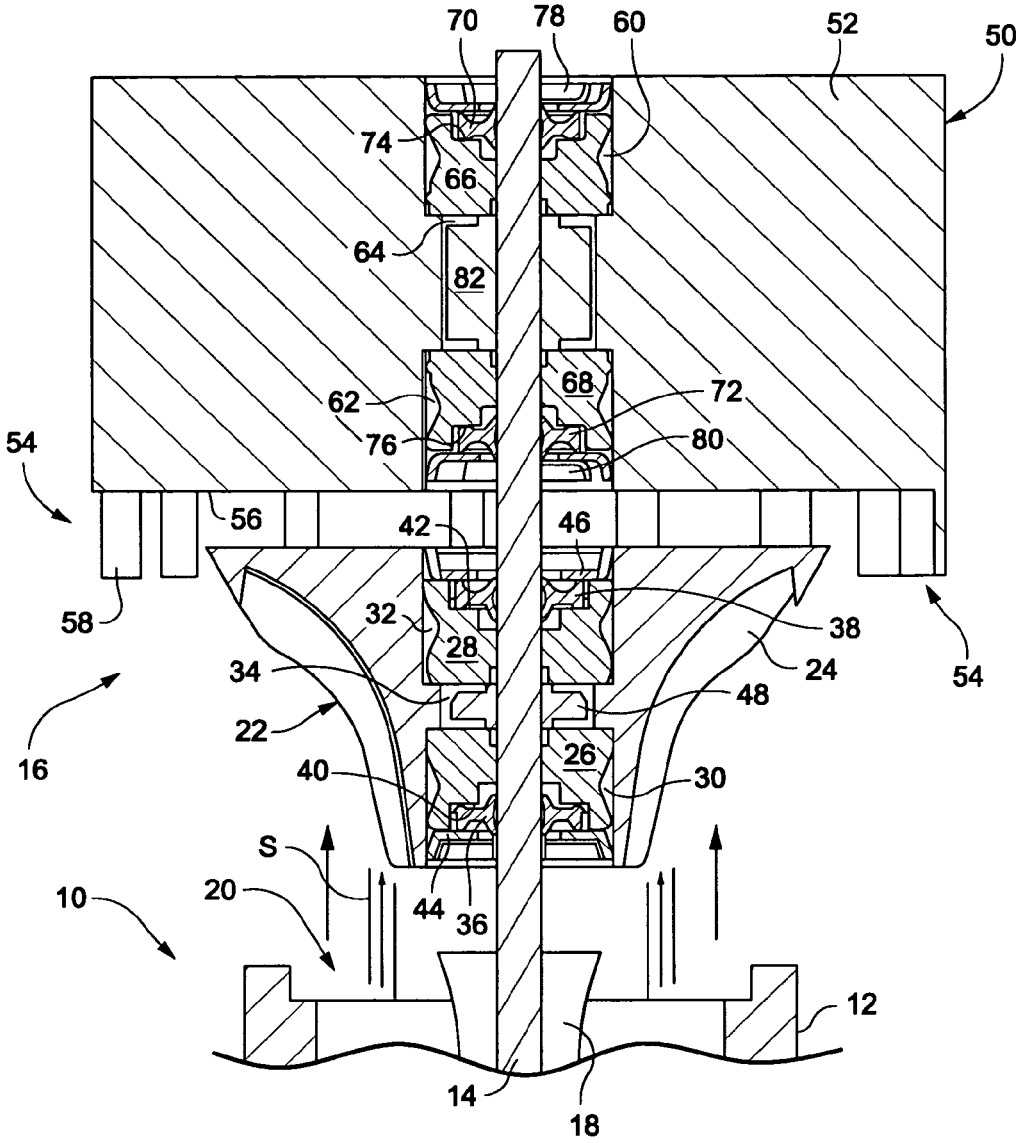
FIG. 1 is a partial cross section through a rotary sprinkler incorporating a water distribution plate and diffuser plate in accordance with a first exemplary embodiment of the invention.
Figure 3:
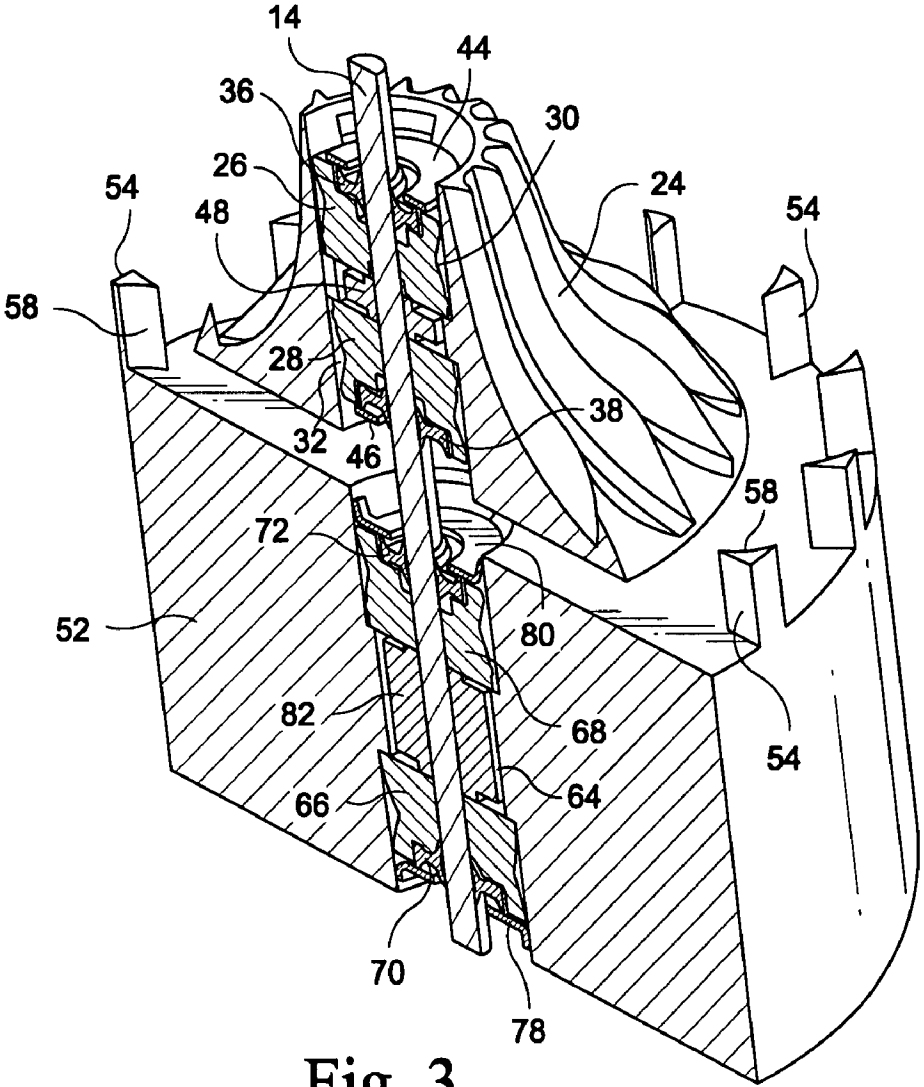
FIG. 3 is a sectioned perspective view of the water distribution and diffuser plates in accordance with the first exemplary embodiment of the invention.
Figure 2:
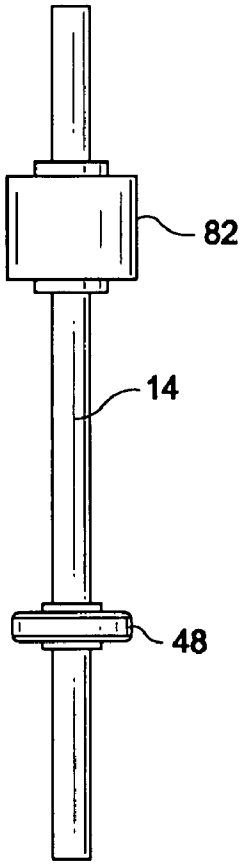
FIG. 2 is a front elevation of a shaft provided with a pair of stator elements as incorporated in the sprinkler shown in FIG. 1.

Referring to FIG. 1, a sprinkler head is partially shown at 10, the sprinkler head incorporating a nozzle 12 and supporting one end of a shaft 14. The shaft 14 (see also FIGS. 2 and 3) extends out of the sprinkler head, in a downstream direction, and supports a water distribution plate and diffuser assembly 16 for impingement by a stream S emitted from the nozzle. A stream deflector 18 is fixed to the shaft 14 and cooperates to define the nozzle orifice 20. The deflector guides an arcuate (or round) stream onto the water distribution plate 22 for redirecting the water in a substantially radially outward direction as described further herein.

More specifically, the water distribution plate 22 is formed with at least one, but in this embodiment with a plurality of grooves 24 shaped to divide a single vertically-oriented arcuate or full 360° stream (or multi-streams) emitted from the nozzle 12 into a plurality of secondary streams or stream components, and to redirect those stream components in a generally radial direction. Grooves 24 are also curved slightly in a circumferential direction such that the water distribution plate 22 is caused to rotate about the shaft 14 as a result of the plurality of stream components acting on the interior walls of the grooves. Such water distribution plates are well-known in the art.

The water distribution plate 22 is also bored and counterbored to receive the shaft 14 and to support a pair of shaft bearings 26, 28 within cavities 30, 32 on either side or end of a smaller diameter center chamber 34. Flexible lip seals 36, 38 are seated on shoulders 40, 42, respectively, in the bearings, with annular retainers 44, 46 press-fit into the cavities to hold the seals in place. Thus, shaft 14 passes through the bearings, seals and retainers, and the distribution plate rotates relative to the shaft.

A first disk-like stator 48 is fixed to the shaft 14 at a location where it will be centered within the chamber 34. The latter is at least partially filled with a viscous fluid (such as a silicone grease), with seals 36, 38 preventing escape of the viscous fluid in opposite directions along the shaft. Rotation of the distribution plate 22 is slowed by the viscous shearing of the fluid as the plate rotates relative to the fixed stator 48.

The diffuser 50 includes a substantially solid, cylindrical body 52, with at least one, but in this embodiment a plurality of diffuser elements 54 projecting downwardly from a peripheral edge of the lower surface 56 of the body 52. The diffuser elements 54 are circumferentially spaced about the lower peripheral edge of the body 52, with uniform or nonuniform spaces therebetween. Each element 54 has a curved vane surface 58 (best seen in FIG. 3) that is arranged to interrupt stream components emanating from the grooves 24 in the water distribution plate, and to drive the diffuser plate to a new position. In this regard, note that the elements 54 are substantially laterally aligned with the upper ends of grooves 24, but recognizing, however, that there are fewer elements 54 than grooves 24.

The manner in which the diffuser 50 is supported on the shaft 14 is generally similar to the manner in which the water distribution plate 22 is supported on the same shaft. Specifically, the diffuser 50 is bored and counterbored to provide a pair of cavities 60, 62 on either side of a second, smaller-diameter chamber 64. The cavities 60, 62 accommodate a second pair of shaft bearings 66, 68 on opposite sides of the center cavity and flexible lip seals 70, 72 are seated on shoulders 74, 76, formed respectively, on the bearings. Retainers 78, 80, hold the respective seals in place.

A second, substantially cylindrical stator 82 is fixed to the shaft 14 so as to be centered within the second chamber 64. A similar viscous fluid fills at least part of the chamber, with seals 70, 72 preventing leakage along the shaft. In this way, the rotation of the diffuser plate is also viscously damped or slowed by viscous shearing in the chamber 64.

In use, when the stream components from the water distribution plate 22 impinge on the diffuser elements 54, the diffuser elements break up the plural stream components to fill in the wetted pattern while at the same time, the diffuser 50 is driven to a new and random position. Thus, the water distribution plate 22 and diffuser 50 rotate about the shaft 14 completely independently of each other. Note that while shaft 14 is normally fixed, i.e., nonrotatable during operation, there may be instances where the shaft is rotatable in an adjustment mode to, for example, throttle flow to the nozzle. In any event, the water distribution plate 22 will rotate substantially continuously as the stream S impinges on the grooves 24. The diffuser 50, on the other hand, will only move when stream components from the water distribution plate grooves 24 strike a vane surface 58 of a diffuser element 54 causing the diffuser 50 to rotate to a different position. The stator 82 is sized to provide enough braking of the diffuser 50 to ensure that it rotates slower than plate 22. Since the number of diffuser-elements is less than the number of grooves in the water distribution plate 22, not all secondary streams leaving the water distribution plate are diffused, and thus the diffuser plate will rotate intermittently to random positions, thus enhancing uniformity of the wetted pattern area.

The commonality between the water distribution plate 22 and the diffuser 50 is the way in which they handle loads. Both stator elements 48, 82 are designed so that with compression loads, the two bearings on either side of these elements are pressed on either side to allow little or no movement. The two plastic bearings also handle axial loading.

Figure 4:
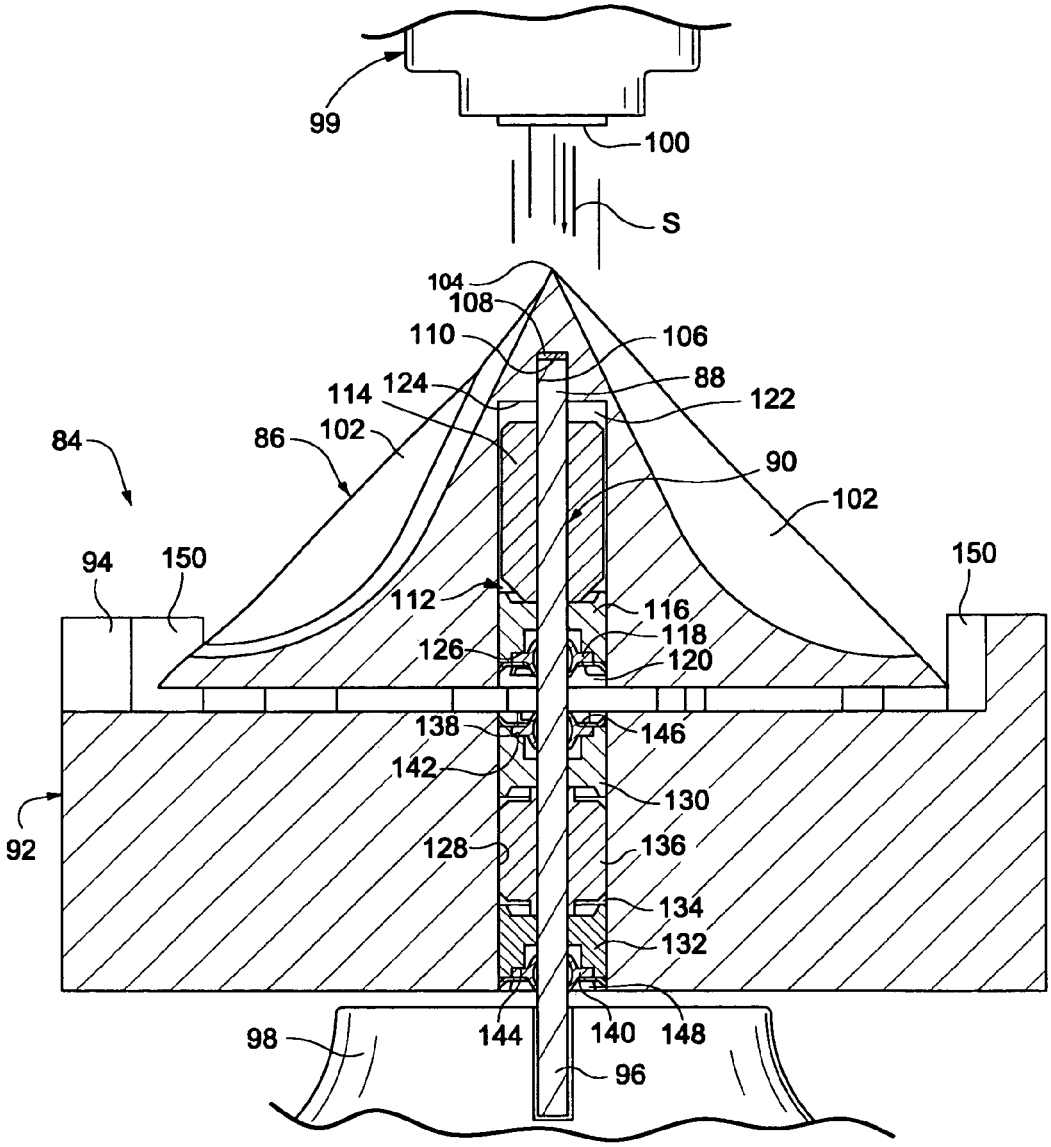
FIG. 4 is a partial cross section through a rotary sprinkler in accordance with a second exemplary embodiment of the invention.
Figure 5:
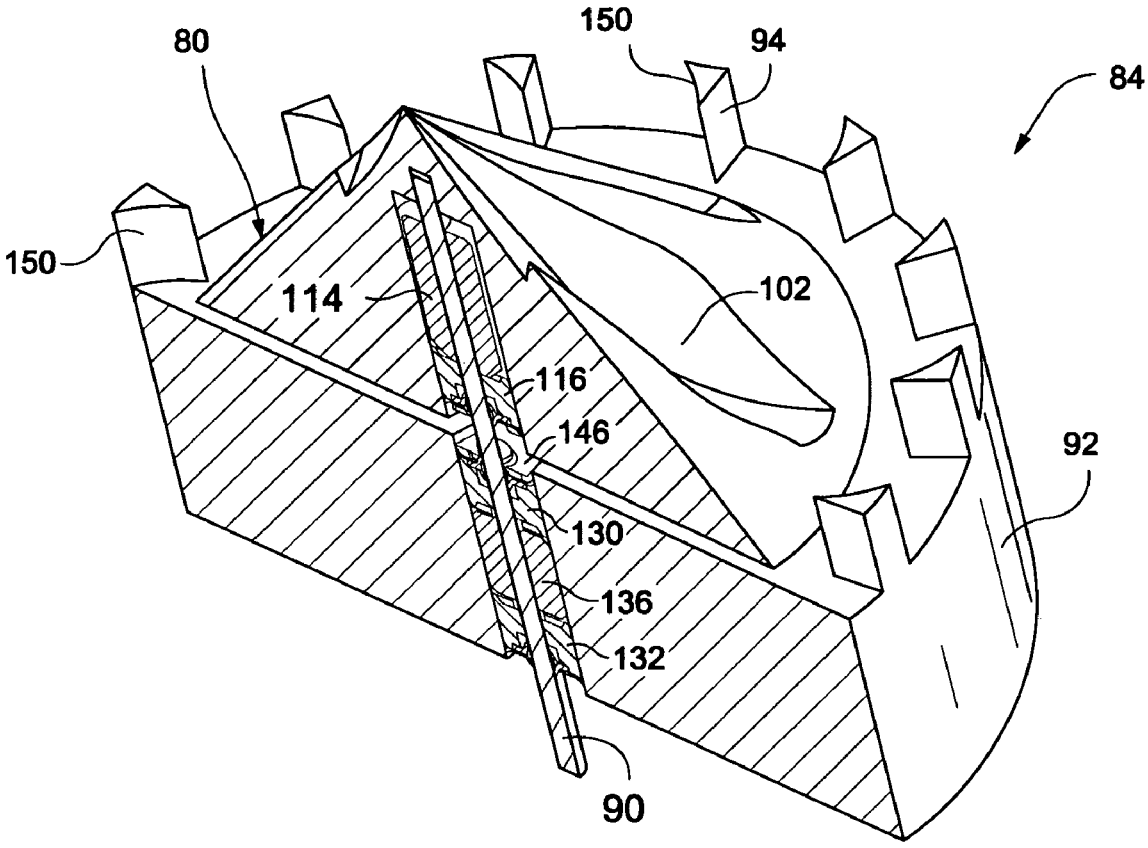
FIG. 5 is a sectioned perspective view of the water distribution plate and diffuser plate shown in FIG. 4.

A second embodiment of a combined water distribution plate/diffuser assembly 84 is shown in FIGS. 4 and 5. In this embodiment, a more sharply defined conically-shaped water distribution plate 86 is supported at one end 88 of a fixed shaft 90. Thus, shaft end 88 terminates within the water distribution plate. A diffuser plate 92 provided with diffuser elements 94 is supported on the shaft 90 adjacent the water distribution plate, and the opposite end 96 of the shaft 90 is fixed within, for example, a cap assembly 98 that is typically supported above (or below) a sprinkler body 99 by one or more struts (not shown). In this instance, a nozzle 100 emits a single solid stream S that is located upstream of the water distribution plate 86, and the shaft 90 forms no part of, nor does it extend through, the nozzle supported in the sprinkler body.

The water distribution plate 86 is formed with grooves 102 that redirect the stream and that cause the plate to rotate on the shaft, but here, the grooves continue to an apex 104 on which the solid stream S impinges and breaks up into secondary streams or stream components that flow through the grooves 102, causing rotation of the plate 86.

The one end 88 of shaft 90 is received in a blind bore 106 formed in the plate 86, with a thrust bearing 108 interposed between the shaft end and the end face 110 of the bore. The blind bore 106 is counterbored to form a cavity 112 that receives a first substantially cylindrical stator 114, a shaft bearing 116, flexible lip seal 118 and retainer 120. A fluid chamber 122 is defined between end face 124 of the cavity 112 and the bearing 116 in which the stator 114 is located. The chamber is at least partially filled with a viscous fluid. The lip seal 118, seated on bearing shoulder 126, prevents escape of the fluid along the shaft.

The diffuser 92 is formed with a centerbore 128 through which the shaft 90 passes. The shaft also passes through a pair of shaft bearings 130, 132 located in the bore 128, defining a second fluid chamber 134 that receives a second substantially cylindrical stator 136 fixed to the shaft. The chamber 134 is at least partially filled with a viscous fluid, with leakage prevented by flexible lip seals 138, 140 seated on respective shoulders 142, 144 of the bearings 130, 132. Annular retainers 146, 148 hold the seals and bearings in place.

In use, the main or primary solid stream S impinges on the grooves 102, forming plural, fully developed secondary streams or stream components that exit the distributor (or first) plate 86 in radial directions. The speed of rotation of the plate 86 is desirably slowed by the shearing action between the silicone fluid in chamber 122 and the first stator 114. The exact speed of rotation can be controlled by the viscosity of the fluid.

When one or more stream components from the water distribution plate 86 strikes a vane surface 150 on a diffuser element 94, the stream components are further broken up to fill in the wetted or distributed pattern and thus establish better uniformity, while at the same time, the diffuser plate 92 is driven to a new random position, due to the difference in number and spacing of the diffuser elements 94 relative to grooves 102. Thus, as in the first-described embodiment, plates 86 and 92 rotate completely independently of each other and at different speeds.

It will be appreciated that equivalents to the viscous damping arrangements disclosed herein may be employed to slow the rotation of one or both of the water distribution and diffuser plates. For example, a friction brake or a gear train may be employed to slow the rotation speed of the plates.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A water distribution plate and diffuser plate assembly for distributing a stream emitted from a sprinkler nozzle comprising:

a shaft having one end attached to a sprinkler component and an opposite end supporting first and second plates in axially spaced relationship for rotation about said shaft independent of one another, said shaft mounted so as not to rotate during operation of the sprinkler; the first plate located adjacent the nozzle and formed with at least one water distribution groove shaped and arranged to divide a primary stream emitted from the nozzle into a plurality of secondary streams, and the second plate located downstream of the first plate and formed with at least one diffuser element arranged to be struck by at least some of the plurality of secondary streams exiting the first plate, and wherein speed of rotation of said first and second plates is braked, wherein said first plate is formed with a first internal chamber surrounding said shaft and said second plate is formed with a second internal chamber surrounding said shaft, said first and second internal chambers containing viscous fluid.

2. The water distribution assembly of claim 1 wherein said shaft is formed with first and second stator elements located within said first and second chambers, respectively.

3. The water distribution assembly of claim 2 wherein the second stator is larger than the first stator.

4. The water distribution assembly of claim 3 wherein said second plate lies axially between said first plate and said sprinkler component.

5. The water distribution assembly of claim 4 wherein said opposite end of said shaft terminates within said first plate.

6. The water distribution assembly of claim 5 including a thrust bearing located between said opposite end of said shaft and said first plate.

7. The water distribution assembly of claim 4 wherein said first plate is formed with a blind bore that receives the shaft, said first chamber closed by a first bearing through which the shaft passes, said first bearing supporting a first seal engaged with said shaft.

8. The water distribution assembly of claim 7 wherein said second plate is formed with a through bore fitted with second and third bearings through which the shaft passes, said second chamber located axially between said second and third bearings, said second and third bearings supporting second and third respective seals engaged with said shaft.

9. The water distribution assembly of claim 3 wherein said first plate lies axially between said second plate and said sprinkler component.

10. The water distribution assembly of claim 9 wherein said opposite end of said shaft terminates within said second plate.

11. The water distribution assembly of claim 2 wherein each of said first and second chambers is defined in part by a pair of bearings located on opposite sides of said first and second stator elements respectively, said shaft passing through each pair of bearings, and wherein each bearing in said pair of bearings supports a seal engaged with said shaft.

12. The water distribution assembly of claim 1 wherein said water distribution grooves are greater in number than said diffuser elements.

13. The water distribution assembly of claim 1 wherein said diffuser elements each comprise a curved vane projecting from a marginal edge of said second plate.

14. The water distribution assembly of claim 13 wherein said diffuser elements are located radially adjacent exit ends of said water distribution grooves, and further wherein said water distribution grooves are greater in number than said diffuser elements.

15. The water distribution assembly of claim 1 wherein said first plate is formed with a plurality of water distribution grooves.

16. The water distribution assembly of claim 1 wherein said second plate is formed with plural diffuser elements.

17. A water distribution plate and diffuser plate assembly for distributing a stream emitted from a sprinkler nozzle comprising:

a shaft having one end attached to a sprinkler component and an opposite end supporting first and second plates in axially spaced relationship for rotation about said shaft independent of one another, said shaft mounted so as not to rotate during operation of the sprinkler; the first plate located adjacent the nozzle and formed with at least one water distribution groove shaped and arranged to divide a primary stream emitted from the nozzle into a plurality of secondary streams, and the second plate located downstream of the first plate and formed with at least one diffuser element arranged to be struck by at least some of the plurality of secondary streams exiting the first plate; said first plate formed with a first internal chamber, with a first stator element secured to said shaft and received in said first internal chamber, said second plate formed with a second internal chamber, with a second stator element secured to said shaft and received in said second internal chamber, said first and second internal chambers at least partially filled with a viscous fluid.

18. The water distribution assembly of claim 17 wherein said first plate lies axially between said second plate and said sprinkler component.

19. The water distribution assembly of claim 18 wherein said first plate is formed with a blind bore that receives the shaft, said first chamber closed by a first bearing through which the shaft passes, said first bearing supporting a first seal engaged with said shaft.

20. The water distribution assembly of claim 19 wherein said second plate is formed with a through bore fitted with second and third bearings through which the shaft passes, said second chamber located axially between said second and third bearings, said second and third bearings supporting second and third respective seals engaged with said shaft.

21. The water distribution assembly of claim 17 wherein said second plate lies axially between said first plate and said sprinkler component.

22. The water distribution assembly of claim 17 wherein each of said first and second chambers is defined in part by a pair of bearings located on opposite sides of said first and second stator elements respectively, said shaft passing through each pair of bearings, and wherein each bearing in said pair of bearings supports a seal engaged with said shaft.

23. The water distribution assembly of claim 17 wherein said first plate is formed with plural water distribution grooves and said second plate is formed with a smaller number of diffuser elements.

24. A water distribution plate and diffuser plate assembly for distributing a stream emitted from a sprinkler nozzle comprising:

a shaft having one end attached to a sprinkler component and an opposite end supporting first and second plates in axially spaced relationship for rotation about said shaft independent of one another; the first plate located adjacent the nozzle and formed with at least one water distribution groove shaped and arranged to divide a primary stream emitted from the nozzle into a plurality of secondary streams, and the second plate located downstream of the first plate and axially between said first plate and said sprinkler component, said second plate formed with at least one diffuser element arranged to be struck by at least some of the plurality of secondary streams exiting the first plate; said first plate formed with a first internal chamber, with a first stator element secured to said shaft and received in said first internal chamber, said second plate formed with a second internal chamber, with a second stator element secured to said shaft and received in said second internal chamber, said first and second internal chambers at least partially filled with a viscous fluid; wherein said first plate is formed with a blind bore that receives said shaft, said first chamber closed by a first bearing through which said shaft passes, said first bearing supporting a first seal engaged with said shaft; and further wherein said second plate is formed with a through bore fitted with second and third bearings through which said shaft passes, said second chamber located axially between said second and third bearings, said second and third bearings supporting second and third respective seals engaged with said shaft.

* * * * *